United States Patent [19]

Arai

[11] 4,383,773

[45] May 17, 1983

[54] SERIAL PRINTER

[75] Inventor: Kenichiro Arai, Shiojiri, Japan

[73] Assignees: Shinshu Seiki Kabushiki Kaisha, Nagano; Kabushiki Kaisha Suwa Seikosha, Tokyo, both of Japan

[21] Appl. No.: 278,142

[22] Filed: Jun. 29, 1981

[30] Foreign Application Priority Data

Jul. 3, 1980 [JP] Japan ..... 55-91056

[51] Int. Cl.[3] ..... B41J 9/06

[52] U.S. Cl. ..... 400/156.3; 101/93.17; 400/154; 400/155.1

[58] Field of Search ..... 400/144.3, 152, 154, 400/154.4, 155.1, 156.2, 156.3, 158, 158.1; 101/93.17, 93.19, 93.20

[56] References Cited

U.S. PATENT DOCUMENTS

| | | | |
|---|---|---|---|
| 215,251 | 5/1879 | Slocum | 400/154 |
| 2,831,424 | 4/1958 | MacDonald . | |
| 2,909,995 | 10/1959 | Hannibal | 101/93.20 |
| 2,949,846 | 8/1960 | Hoffman et al. . | |
| 3,742,845 | 7/1973 | Giani | 101/93.19 |
| 3,908,809 | 9/1975 | Beattie | 400/144.3 |
| 3,924,725 | 12/1975 | Kuhn | 101/93.19 X |
| 3,987,884 | 10/1976 | Buxton | 400/154.4 X |
| 4,043,439 | 8/1977 | Daly . | |

*Primary Examiner*—Paul T. Sewell

*Attorney, Agent, or Firm*—Blum, Kaplan, Friedman, Silberman & Beran

[57] ABSTRACT

A serial printer for use in portable electronic calculators and the like. The printer includes a single printing head having a plurality of characters divided into two groups circumferentially disposed therearound in a predetermined pattern. A first selecting mechanism selects one of the two groups of characters. A second selecting mechanism selects the particular character in the group selected by the first selecting mechanism which is to be printed on a printing tape. The first selecting mechanism may include a helical gear mechanism which selects between the two groups of characters.

21 Claims, 6 Drawing Figures

SERIAL PRINTER

BACKGROUND OF THE INVENTION

This invention is directed to a serial printer and, in particular, to a serial printer suitable for use in hand-held portable electronic calculators or the like which includes a single printing head which carries two groups of characters alternately arranged thereon.

The printing operations performed by a serial printer which is typically used with portable electronic devices such as hand-held calculators or the like are generally performed such that a mathematical symbol, which indicates the operation performed, is printed in the first column on the printing tape and numerals are printed in the remaining columns on the printing tape. In the conventional printing method, a first type wheel which carries the symbols and a second type wheel which carries the numerals are provided such as is disclosed in Japanese Patent Laid-Open Publication No. 52-46930. In this type of printer having two type wheels, the symbols or numerals to be printed are selected by means of complex mechanisms.

In an alternative printing method, a single printing head carries both symbols and numerals on its outer circumference such as disclosed in Japanese Patent Laid-Open Publication No. 51-112617. Such a printing method is advantageous in that the construction of the printer is simplified. However, this type of printer takes a relatively long time to select the necessary symbol or numeral to be printed and a large electromagnet is generally required in order to increase the printing speed. It is, of course, desirable to have a simple, inexpensively constructed printer for use in portable electronic calculators or the like. Accordingly, a serial printer for use especially in portable electronic calculators or the like which includes a single printing head which carries both symbols and numerals and which has a simplified construction and is inexpensive to manufacture, is desired.

SUMMARY OF THE INVENTION

Generally speaking, in accordance with the instant invention, a serial printer adapted for use in portable electronic calculators or the like which includes a single printing head, is provided. The printer includes a printing head which is laterally translatable across the surface of a printing tape or paper. The printing head carries a first group of characters such as symbols and a second group of characters such as numerals which are circumferentially disposed therearound in an alternating sequence. A first selecting mechanism which may include a helical gear arrangement selects either the first group of characters or the second group of characters from which a particular character is desired to be printed. A second selecting mechanism selects which of the particular characters from the group of first or second characters selected is to be printed on the printing tape. A print mechanism prints the character selected on the printing tape.

A relatively small electromagnet is provided in the printer to operate same which can be driven at a low voltage. The construction of the printer of the present invention is remarkably simplified over conventional printer constructions and hence is easy to manufacture. This results in a low manufacturing cost.

Accordingly, it is an object of the instant invention to provide an improved serial printer for use in portable electronic calculators or the like.

Another object of the instant invention is to provide an improved serial printer which includes a single printing head which carries both the numerals and symbols to be printed.

A further object of the instant invention is to provide a serial printer which is simplified in construction and inexpensive to manufacture.

Yet another object of the invention is to provide an inexpensive micro serial printer which uses a single printing head and has a high printing speed and simplified construction.

A still further object of the invention is to provide an improved serial printer which has a low power consumption.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
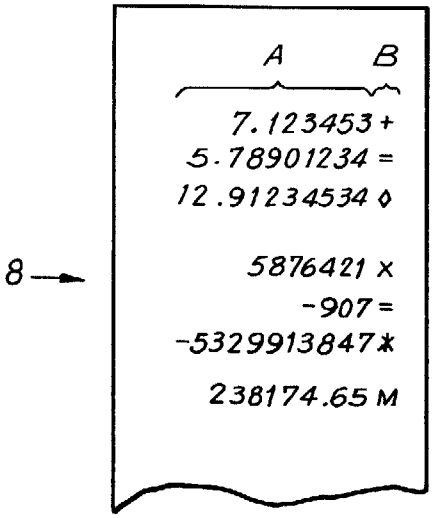
FIG. 1 is an example of a printing tape having characters such as numerals and symbols printed thereon as printed by a serial printer.

Reference is first made to FIG. 1 which depicts an example of a piece of printing paper or tape, generallly indicated as 8. A serial printer in a portable calculator or the like prints numerals, decimal points, negative signs and the like in the columns indicated by the letter A. The printer prints mathematical or other symbols in the column indicated by the letter B which indicate the particular operation performed by the calculator on the numerals in section A on printing tape 8.

Conventional printers used in electronic calculators generally include a first printing head or wheel which carries the symbols to be printed in section B. The first printing head is generally stationary with respect to the printing tape since the symbols are only printed in the first (right) column. A second printing head or wheel carries the numerals, decimal point, negative sign and the like. The second printing head is laterally translatable across the printing tape so as to be able to print numerals in selected columns in section A on tape 8. The printing tape is advanced line by line for consecutive printing in rows thereon by the two printing wheels. Where two print wheels are required as discussed above, a complex operating mechanism is required.

The present invention is particularly directed to a serial printer which includes a single print wheel which includes both the numerals and other marks which are printed in the columns in section A on printing tape 8 and the symbols which are printed in the first (right) column in section B.

Figure 2:
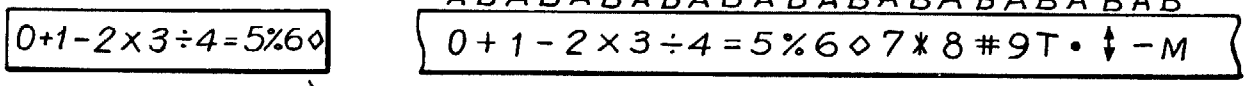
FIG. 2 depicts an example of the arrangement of characters including numerals and symbols on the printing head arranged in accordance with the present invention.

FIG. 2 depicts the arrangement of characters on the print wheel used in the present invention, including both numerals and symbols. Reference letters A refer to the numerals and other mathematical indicia (decimal point and negative sign) which are printed in section A on tape 8 in FIG. 1. Reference letters B refer to the symbols which are printed in section B in the first (right) column on tape 8 in FIG. 1. The numerals and other indicia indicated by the letter A are alternately disposed with the symbols designated by the letter B so that a numeral, decimal point or negative sign is disposed in every other position with a symbol disposed in the alternating spaces between the numerals. It is noted that other arrangements of characters are possible in accordance with the invention.

Figure 3:
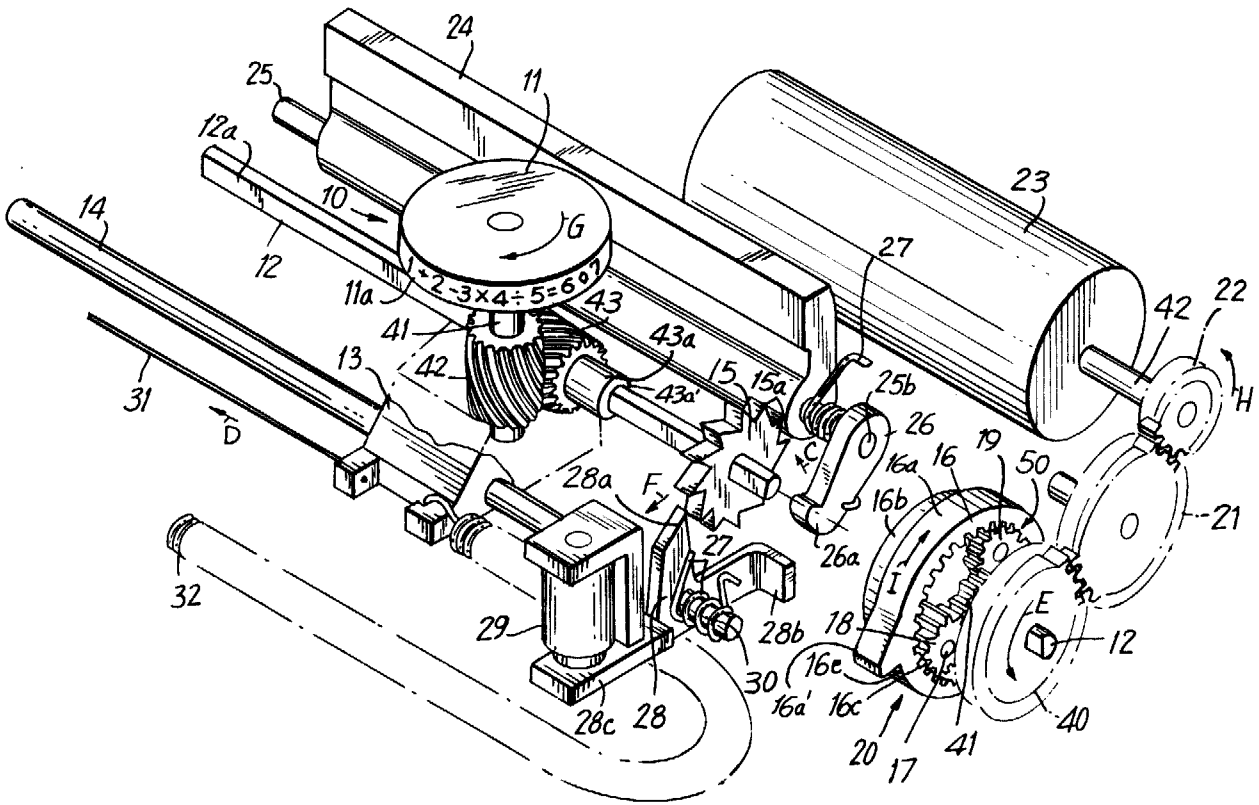
FIG. 3 is a perspective view, partially exploded, of a serial printer constructed and arranged in accordance with the instant invention.

Referring to FIGS. 3 through 6, the construction of the serial printer of the present invention will now be described. A printing head, generally indicated as 10, includes a cylindrical print or type wheel 11 which includes the characters to be printed. The characters are circumferentially disposed around type wheel 11 on rim 11*a* thereof. As aforenoted, with reference to FIG. 2, the characters which includes a group of numerals and a group of symbols are alternately disposed on rim 11*a* of type wheel 11. Printing head 10 includes an axle 41 fixed to type wheel 11 which extends perpendicular therefrom so that type wheel 11 is essentially horizontal as depicted in FIG. 3.

Axle 41 is rotatably supported on a carriage 13. A first helical gear 42 is mounted on axle 41 for meshing engagement with a second helical gear 43. Gear 43 is axially supported on a selecting shaft 12 so as to be able to move therealong but is fixed on shaft 12 so as to rotate therewith. In this regard, shaft 12 may include a flat surface 12*a* and helical gear 43 may include a correspondingly shaped opening 43*a* therein so that gear 43 can slide along shaft 12 but not be rotatable with respect thereto.

Figure 4:
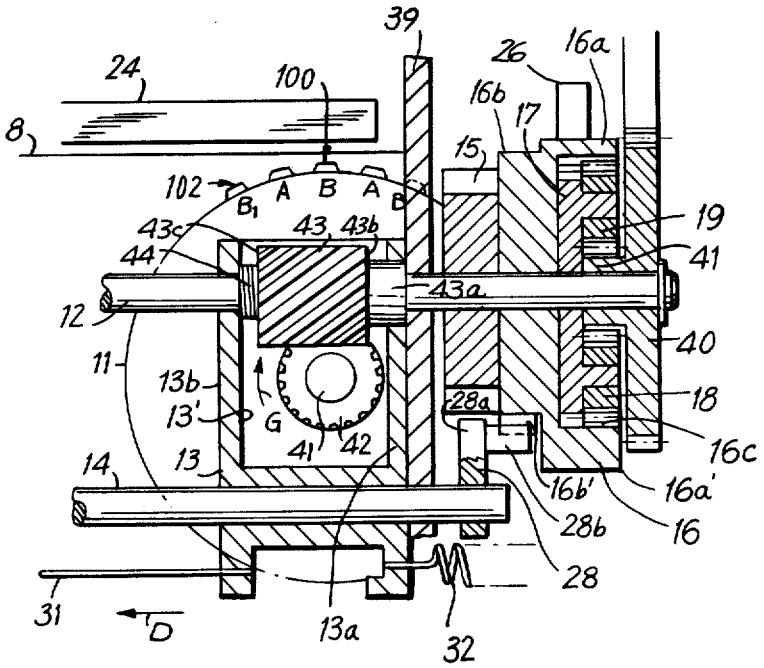
FIG. 4 is a top plan view, in partial section, of the printer depicted in FIG. 3 in the start position.

As best depicted in FIG. 4, carriage 13 includes side walls 13*a* and 13*b* which define an opening 13' therebetween. Helical gear 43 is captured between walls 13*a* and 13*b* in opening 13'. A compression spring 44 between wall 13*b* of carriage 13 and side face 43*c* of helical gear 43 biases gear 43 in the direction opposite to that indicated by arrow D. Side face 43*b* of helical gear 43 includes a collar 43*a* which extends therefrom through an opening in wall 13*b*. It the position depicted in FIG. 5, collar 43*a* extends beyond wall 13*a* due to the force exerted by spring 44.

Carriage 13 is slidably supported on selecting shaft 12 and a guide shaft 14. A selecting ratchet wheel 15 is secured on shaft 12 so as to be rotatable therewith. Ratchet wheel 15 includes teeth 15*a* which are cut so as to enable selection of alternate characters on print wheel 11 as more fully described below. After either the numerals in group A or the symbols in group B are selected by helical gear 43 as described below, ratchet wheel 15 selects the specific character in the group selected to be printed by selectively positioning that character in front of the printing tape.

A differential gear mechanism is generally indicated at 20. Differential gear mechanism 20 includes a printing cam 16 which is supported by shaft 12 through a central opening 16'. Printing cam 16 includes an internal gear 16*c* around the inner circumference thereof. The outer circumference of printing cam 16 includes a cam portion 16*a* having a cam 16*a'* and a notched portion 16*b* having a notch 16*b'*.

A planet gear mechanism, generally indicated at 50, is disposed in printing cam 16. Planet gear mechanism 50 includes planet gears 18 and 19 which are rotatably coupled 180° apart to a planet lever 17. Planet gears 18 and 19 are meshingly engaged with internal gear 16*c*. Planet lever 17 is fixedly secured to shaft 12 so as to be rotatable therewith. A drive gear 40 supported by shaft 12 includes a sun gear 41 fixed thereto which is meshingly engaged with planet gears 18 and 19.

Gear 40 is meshingly engaged with a gear 21 which in turn is meshingly engaged with a gear 22 which together form the transmission drive of the printer. Gear 22 is secured to a drive shaft 42 of a motor 23 which rotates gear 22 in the direction of arrow H to drive the aforedescribed gear train.

A printing hammer or platen 24 is arranged proximate type wheel 11 and extends along the path of printing. Platen 24 is fixedly secured to a hammer shaft 25. A printing lever 26, which is secured to end 25*b* of hammer shaft 25, is spring biased by a torsion spring 27 in the direction indicated by arrow C. Spring 27 biases printing lever 26 so that end 26*a* thereof is biased against cam portion 16*a* of printing cam 16.

A selecting pawl 28 is pivotally coupled to guide shaft 14 and includes a pawl portion 28*a* which meshes with selecting ratchet wheel 15, an engagement portion 28*b* which engages with notch 16*b'* or printing cam 16 and an attracting (armature) portion 28*c* which lies proximate an electromagnet 29. Selecting pawl 28 is normally urged in the direction of arrow F by a torsion spring 30, as best viewed in FIG. 6. However, upon activation of electromagnet 29, attracting portion 28*c* is attracted to magnet 29 so that pawl 28 pivots in a direction opposite to that of arrow F to the position depicted in phantom in FIG. 6.

A wire 31 is joined to carriage 13 which selectively pulls carriage 13 by means of a winding drum or the like (not shown) in the direction of arrow D in order that print wheel 11 can print across lines on the printing paper. A return spring 32 is joined at one end thereof to carriage 13 and pulls carriage 13 in a direction opposite to that indicated by arrow D so as to return carriage 13 to its standby or start position after the force exerted by wire 31 is released.

The operation of the serial printer of the present invention will now be described. When the force exerted by wire 31 is released, return spring 32 returns carriage 13 and hence print head 10 to the standby position depicted in FIG. 4. In the standby position, collar 43*a* on helical gear 43 abuts against a side frame 39 of the printer. Since the force exerted on carriage 13 by return spring 32 is stronger than the force exerted by spring 44 on helical gear 43, spring 44 is compressed so that wall 13*a* of carriage 13 also abuts against frame 39. At this time, if selecting ratchet wheel 15 and pawl portion 28a of selecting pawl 28 mesh together, a character 100 from the group of symbols of group B is positioned so as to face printing hammer 24.

Figure 6:
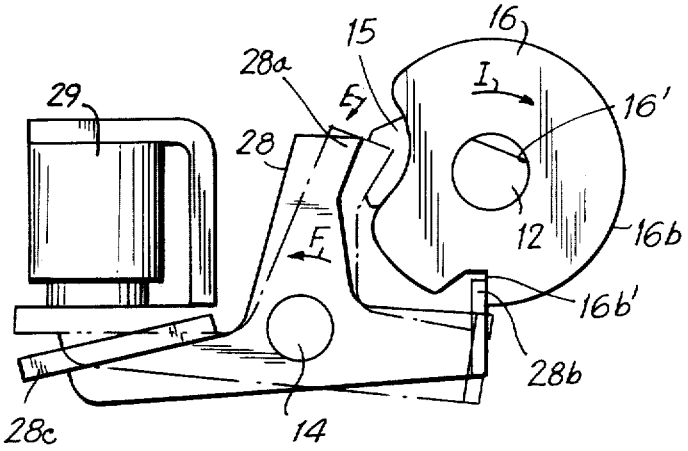
FIG. 6 is a right side elevational view, including a portion in phantom, of the printer selecting mechanism depicted in FIG. 3.

Engagement portion 28b of selecting pawl 28 normally engages with the notch 16b' of printing cam 16 as best depicted in FIG. 6 to thereby stop the rotation of printing cam 16. When drive shaft 42 of motor 23 is rotated so that motor gear 22 rotates in the direction of arrow H, sun gear 41 will be rotated in the direction of arrow E through the rotation of transmission gears 21 and 40. Since printing cam 16 is stopped from rotating by selecting pawl 28, planetary gears 18 and 19 will roll around internal gear 16c to thereby swing planet lever 17 in the direction of arrow E. When planet lever 17 is rotated, both selecting shaft 12 fixed to lever 17 and selecting ratchet wheel 15 fixed to selecting shaft 12 are rotated in the direction arrow E. As a result, print wheel 11 is also rotated in the direction of arrow G through the meshing action of helical gears 42 and 43.

As aforenoted, when print head 10 is in the start position depicted in FIG. 4, helical gear 43 will be compressed against compression spring 44 so that helical gear 43 is in the left position as depicted in FIG. 4. In this position, when ratchet wheel 15 is held stationary by pawl 28, one of the symbols from group B will be facing platen 24. The teeth 15a on ratchet wheel 15 are spaced thereon so that the meshing between any one of the teeth and pawl 28 will require a symbol from group B to be facing platen 24.

When electromagnet 29 is energized while print head 10 is in its standby or start position, the symbol from group B desired to be printed will be located at position 102 as depicted in FIG. 4, the position of which is determined by a position signaling mechanism (not shown). The energization of electromagnet 29 swings selecting pawl 28 in the direction opposite to that indicated by arrow F so that meshing (pawl) portion 28a of selecting pawl 28 is brought into meshing engagement with a tooth on selecting ratchet wheel 15 to thereby prevent ratchet wheel 15 from rotating. Since ratchet wheel 15 is secured to selecting shaft 12, the rotation of selecting shaft 12 will stop and print wheel 11 will also stop rotating such that the symbol $B_1$ at position 102 is brought into position 100 so that symbol $B_1$ is ready to be printed. When selecting pawl 28 is rotated in the direction opposite to that indicated by arrow F into engagement with selecting ratchet wheel 15, engagement portion 28b thereof is disengaged from notch 16b' of printing cam 16, as depicted in phantom in FIG. 6, so that printing cam 16 is free to rotate. Since sun gear 41 is continuously rotated by the action of motor 23, the rotation thereof is transmitted to planetary gears 18 and 19 when planet lever 17 is stopped to thereby rotate internal gear 16c and hence printing cam 16 in the direction indicated by arrow I.

When printing cam 16 rotates, cam 16a' presses against printing lever 26 to pivot same. Hammer shaft 25 is pivoted thereby and hence printing hammer 24 pivots in the direction opposite to that indicated by arrow C so that hammer 24 depresses print tape 8 against character $B_1$ in position 100 so that character $B_1$ is printed on the paper in the first (right) column. A lead 16e is formed in printing cam 16 so that the printing of character $B_1$ is completed upon one-half rotation of printing cam 16.

While printing cam 16 continues rotating, wire 31 is wound by the winding drum (not shown) so that carriage 13 is shifted one position (column) in the direction indicated by arrow D. After printing cam 16 has completed one rotation, engagement portion 28b of selecting pawl 28 is engaged with notch 16b' of printing cam 16 due to the force exerted by spring 30 so that printing cam 16 is stopped once again. At this time, meshing portion 28a of selecting pawl 28 is disengaged from selecting ratchet wheel 15 so that selecting ratchet wheel 15, selecting shaft 12, type wheel 11 and planet lever 17 restart their respective rotations.

Figure 5:
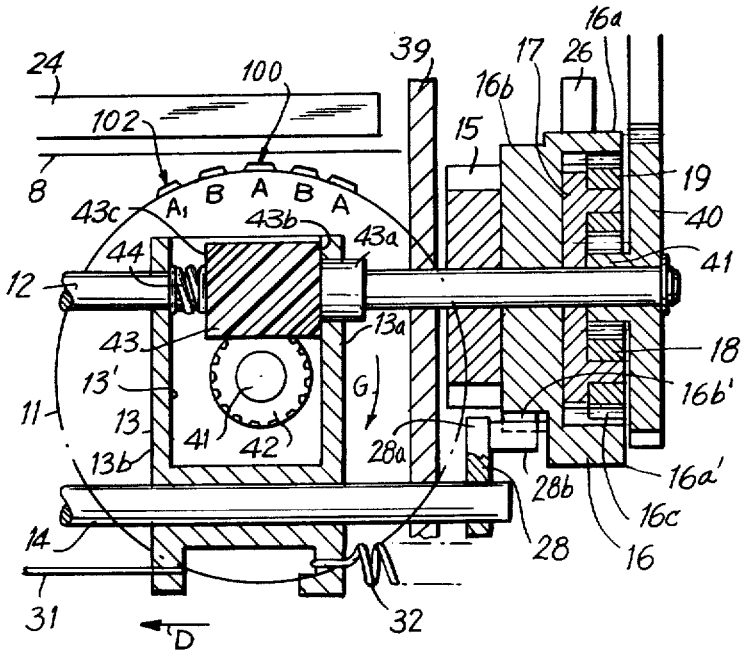
FIG. 5 is a top plan view, in partial section, of the printer depicted in FIG. 3 after the printing head has moved from its start position.

After carriage 13 is shifted one position in the direction of arrow D as depicted in FIG. 5, helical gear 43 moves in the opposite direction to that indicated arrow D due to the force exerted by spring 44. At this time, since helical gear 43 is moved to the right as depicted in FIG. 5, it rotates helical gear 42 on shaft 41 in the direction of arrow G through a small angle equal to about $1/24 \times 360° = 15°$, since there are 24 characters disposed on print wheel 11. This in turn rotates print wheel 11 so that one of the characters in group A will face platen 24 when ratchet 15 is engaged. This small rotation of print wheel 11 causes the teeth on ratchet wheel 15 to correspond to the characters in group A so that when selecting ratchet 15 is held by pawl 18, one of the characters from group A will face printing paper 8. To print in the second column, electromagnet 29 is energized when the desired character in group A is at position 102, as depicted in FIG. 5, so that selecting pawl 18 will stop the rotation of ratchet wheel 15 to bring the character $A_1$ in position 102 into position 100 so that it is ready to be printed. The above printing process is repeated and the character is printed on printing tape 8.

During the printing operation, printing cam 16 is rotated in the same manner as discussed above by the action of the differential gear mechanism 50 to thereby effect the printing of the character from group A and the carriage is moved one position (column) so that the next figure can be printed. Since helical gear 43 is urged in the direction opposite to that indicated by arrow D in every position other than the standby or start position, the character facing printing hammer 24 will always belong to group A whenever selecting ratchet 15 is stopped. When the selecting, printing and carriage moving operations are repeated until the last figure is printed, the winding drum is reset by a carriage returning signal so that carriage 13 is moved in the direction opposite to arrow D by the force of return spring 32 until it is returned to the initial standby or start position once again. At this time, printing paper 8 is fed one line by a conventional paper advancing mechanism so that printing of the next line can begin.

As herein described, although type wheel 11 carries 24 different characters on its outer circumference as depicted in FIG. 2, it operates as two print wheels each carrying 12 characters. As a result, the time period for applying power to the electromagnet can be preset so that it is equal to the time period when two separate type wheels are used. A high printing speed can be obtained without a large electromagnet driven by a large current. Moreover, since in the present invention only one type wheel is used, the construction is simplified and the size of the printer is substantially reduced.

Although the present invention has been described with specific reference to numerals and mathematical symbols as the characters on the print wheel, the present invention is not to be construed as limited thereto. Moreover, although the printer described herein has been described by using a differential gear mechanism for interchanging between the two groups of characters, other types of changing mechanisms would be possible.

In my copending application entitled Serial Printer and filed on even date, other embodiments of the serial printer described herein are disclosed.

According to the present invention, since the characters are divided into a first group of characters such as symbols and a second group of characters such as numerals and these two groups of characters are alternately arranged on the outer circumference of a single type wheel, and since a helical gear train is interposed between the character selecting mechanism and the type wheel, the single type wheel can be handled substantially similar to the construction in which two type wheels are used so that the time period for applying power to the electromagnet can be elongated without decreasing the printing speed. Moreover, the printer can be driven at a low voltage and at a low current can be operated by the use of a small electromagnet. Finally, since it is sufficient to use a single type wheel, the construction is remarkably simplified with an added effect that a small and inexpensive micro serial printer for a hand-held electronic calculator or the like can be provided.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is

1. A serial printer for printing characters on a printing tape comprising a frame, a printing head having a type wheel with an outer circumference, said type wheel having a first group of characters and at least a second group of characters alternately disposed on the outer circumference thereof, first selecting means for selecting one of said first and second groups of characters, said first selecting means including helical gear means for orienting said type wheel with respect to said printing tape so that one of said first and second groups of characters is selected, selecting shaft means rotatably supported on said frame and motor means for rotating said selecting shaft means, said helical gear means including a first helical gear slidably supported on said selecting shaft means for rotation therewith, said first helical gear being laterally displaceable with respect to said printing head between a first position where said first group of characters is selected and a second position where said second group of characters is selected, second selecting means for selecting one of said characters in said group selected by said first selecting means to be printed, and print means for printing the character selected by said second selecting means on said printing tape.

2. The serial printer, as claimed in claim 1, wherein said helical gear means includes first biasing means for biasing said first helical gear in said second position.

3. The serial printer, as claimed in claim 2, wherein said helical gear means includes a second helical gear in meshing engagement with said first helical gear at the first and second positions thereof and mounted on said printing head, said type wheel being joined to said second helical gear for rotation therewith.

4. The serial printer, as claimed in claim 3, wherein said second selecting means includes ratchet means secured to said selecting shaft means for selectively stopping the rotation of said selecting shaft means so that a character on said type wheel in said first or second group selected by said first selecting means can be printed on said printing tape.

5. The serial printer, as claimed in claim 4, wherein said second selecting means further includes pawl means for selectively engaging said ratchet means and electromagnet means for selectively controlling said pawl means.

6. The serial printer, as claimed in claim 5, wherein said ratchet means includes a plurality of teeth spaced on said ratchet means, the spacing of said characters in said first group corresponding to the spacing of said characters in said second group, the spacing of said teeth corresponding to the common spacing of said first and second group of characters disposed on said type wheel.

7. The serial printer, as claimed in claim 6, wherein said print means includes printing cam means coupled to said selecting shaft means for printing the character selected by said second selecting means on said printing tape.

8. The serial printer, as claimed in claim 7, wherein said printing cam means includes planet gear means having a planet lever secured to said selecting shaft means, said planet lever having at least one planet gear rotatably secured thereto, said printing cam means having an internal gear which meshingly engages with said planet gear, said motor means including a sun gear driven thereby which is meshingly engaged with said planet gear.

9. The serial printer, as claimed in claim 8, wherein said pawl means includes engagement means which selectively prevents said printing cam means from rotating, said planet gear means rotating said selecting shaft means when said engagement means prevents said printing cam means from rotating.

10. The serial printer, as claimed in claim 9, wherein said pawl means includes second biasing means for biasing said pawl means in a first position where said engagement means is engaged with said printing cam means, the activation of said electromagnet means moving said pawl means into a second position where said pawl means meshes with said ratchet means and said engagement means is released from said printing cam means.

11. The serial printer, as claimed in claim 10, wherein said print means includes printing hammer means pivotally coupled to said frame means for pressing said printing tape against the character selected to be printed by said second selecting means and lever means coupled to said printing hammer means for pivoting same, said printing cam means pivoting said lever means when said pawl means is in its second position.

12. The serial printer, as claimed in claim 2, 3, 5 or 11, wherein said printing head is laterally translatable across said printing tape in a plurality of steps for printing characters in a plurality of columns across said printing tape.

13. The serial printer, as claimed in claim 12, wherein said helical gear means includes positioning means for positioning said first helical gear in its first position when said printing head is in one said plurality of steps.

14. The serial printer, as claimed in claim 13, wherein said positioning means includes an axially extending member coupled to said first helical gear, said extending member abutting against said frame when said printing head is in one said plurality of steps for holding said first helical gear in said first position.

15. The serial printer, as claimed in claim 14, wherein one of said steps is a start step where said printing head prints in a first said column, said extending member abutting against said frame when said printing head is in said start step so that said first group of characters is selected.

16. The serial printer, as claimed in claim 15, wherein said extending member is released from said frame and said first helical gear is displaced to its second position by said first biasing means at the other of said steps.

17. The serial printer, as claimed in claim 1, wherein said second selecting means includes ratchet means for selecting the character to be printed from the group of characters selected by said first selecting means, said ratchet means being fixed on said selecting shaft means for rotation therewith, said ratchet means including a plurality of teeth spaced thereon, the spacing of said characters in said first group corresponding to the spacing of said characters in the second group, the spacing of said teeth corresponding to the common spacing of said first and second group of characters, said second selecting means further including pawl means pivotally supported on said frame for selectively engaging with said ratchet means and electromagnet means for selectively operating said pawl means, and planet lever means having a planet lever secured to said selecting shaft means, said planet lever having at least one planet gear rotatably secured thereto, said motor means including a sun gear meshingly engaged with said planet gear.

18. The serial printer, as claimed in claim 17, wherein said pawl means includes first biasing means for biasing said pawl means in a first position where said planet lever rotates said selecting shaft means, said electromagnet means, upon actuation thereof, pivoting said pawl means so that it engages with said ratchet means to stop the rotation of said selecting shaft means.

19. A serial printer for printing characters on a printing tape comprising a frame, a printing head slidably supported on said frame having a type wheel, said type wheel including a first group of characters and a second group of characters circumferentially disposed thereon in an alternating arrangement, first selecting means for selecting one of said first and second group of characters, second selecting means for selecting one of said characters in the group selected by said first selecting means to be printed, said first selecting means including helical gear means coupled to said printing head for positioning said printing head so that one of said first and second groups is selected, said second selecting means including a ratchet wheel having a plurality of teeth spaced thereon, the spacing of said characters in said first group corresponding to the spacing of said characters in said second group, the spacing of said teeth corresponding to the common spacing of said first and second group of characters, selecting shaft means rotatably supported by said frame in the path of said printing head, said helical gear means including a first helical gear slidably supported on said selecting shaft means for rotation therewith and displaceable with said printing head, and a second helical gear mounted on said printing head in meshing engagement with said first helical gear, said second helical gear being joined to said type wheel for rotation therewith, said first helical gear being axially displaceable while remaining in meshing engagement with said second helical gear between a first position where said first group of characters is selected and a second position where said second group of characters is selected, and print means for printing the character selected by said second selecting means on said printing tape.

20. The serial printer, as claimed in claim 19, wherein said helical gear means includes biasing means for normally biasing said first helical gear in said second position when said second group of characters is selected.

21. The serial printer, as claimed in claim 20, wherein said first helical gear includes a projection for engagement against said frame at a first position of said printing head to effect displacement of said first helical gear frame to its first position, and being out of engagement with said frame at other positions of said printing head at which said first helical gear is at its second position.

* * * * *